United States Patent [19]

DeMott

[11] Patent Number: 4,950,509

[45] Date of Patent: Aug. 21, 1990

[54] MINIATURE TREE SCULPTURE

[76] Inventor: Donald T. DeMott, 1452 Branch Ave., Simi Valley, Calif. 93065

[21] Appl. No.: 381,028

[22] Filed: Jul. 17, 1989

[51] Int. Cl.[5] ..... A47G 33/06

[52] U.S. Cl. ..... 428/18; D 11/118; 156/61; 428/22; 434/81

[58] Field of Search ..... D 11/118; 156/61; 428/17, 18, 21, 39, 22; 434/81, 82, 96

[56] References Cited

U.S. PATENT DOCUMENTS

| | | | |
|---|---|---|---|
| 1,773,824 | 8/1930 | Scheibner | 428/18 X |
| 1,829,687 | 10/1931 | Takiguchi | 428/18 |
| 2,876,575 | 3/1959 | Leika | 428/90 X |
| 2,937,931 | 5/1960 | Nugent | 428/39 X |
| 3,976,807 | 8/1976 | Sweeney et al. | 428/16 |
| 4,021,936 | 5/1977 | Stolzer | 428/18 X |
| 4,435,452 | 3/1984 | Hernandez et al. | 428/18 X |

*Primary Examiner*—Henry F. Epstein

*Attorney, Agent, or Firm*—Poms, Smith, Lande, & Rose

[57] ABSTRACT

A miniature tree sculpture wherein the leaves for the miniature tree are seeds or seed hulls adhesively bonded to an imitation branch structure which in turn is connected to the miniature tree truck. Seed hulls dyed different shades of green, red, orange and yellow provide a realistic miniature tree sculpture which is beautifully delicate, yet durable.

14 Claims, 1 Drawing Sheet

MINIATURE TREE SCULPTURE

BACKGROUND OF THE INVENTION

1. Field of the Invention

The present invention relates generally to miniature artificial trees and methods for fabricating such trees. More particularly, the present invention relates to making a miniature tree sculpture which provides a realistic tree sculpture which is beautifully delicate yet extremely durable.

2. Description of Related Art

Artificial miniature trees are used as part of architectural scale models, city planning models and other miniature models where a realistic landscape presentation is desired as part of the layout. Miniature trees may also be used in combination with other materials to provide a miniature landscape which is displayed alone for its beauty and artistic value.

When creating a miniature tree, it is desirable that the tree provide a realistic visual image including the presence of leaves. This presents a problem because the delicate structure and appearance of real leaves is difficult to imitate on a miniature scale. Further, difficulties arise because the miniature leaves tend to be delicate and can easily be damaged during handling and/or shipping. It therefore would be desirable to provide a miniature tree which includes leaves which realistically convey the delicacy and beauty of real leaves while being sufficiently durable to resist damage due to rough handling.

In order to make the production of realistic miniature trees commercially viable, the method for making the trees must be relatively simple, efficient and reproducible. In addition, the process must not require time consuming and labor intensive steps such as individual attachment of each leaf to the miniature branch structure.

SUMMARY OF THE INVENTION

In accordance with the present invention, a miniature tree sculpture is provided which is beautifully realistic in reproducing delicate leaf structures on a miniature scale. Further, the tree sculpture is durable and resists damage due to rough handling or abuse.

The present invention is based on a miniature tree sculpture which includes a miniature imitation tree trunk and branch structure upon which a plurality of imitation leaves are adhesively bonded. The imitation leaves are seeds or seed hulls. Seed hulls provide a particularly realistic and beautiful miniature representation of delicate leaf structure. Coloring of the seed hulls in accordance with the present invention further adds to the realism and beauty of the miniature tree sculptures.

It was discovered, as a feature of the present invention, that coating the outer surfaces of the seed hulls with a protective layer resulted in increased durability of the delicate seed hulls without altering their ability to realistically imitate real leaves. Further, it was discovered that dyed millet seed hulls were especially well suited for providing a realistic and beautiful miniature aspen tree sculpture.

As another feature of the present invention, it was discovered that the seed hulls or grass seed can be applied to the miniature tree branch structure by simply coating the branch structure with adhesive and immersing the structure in a bed of grass seeds or seed hulls.

This feature is especially useful when a number of tree sculptures need to be made in commercial quantities.

Further, it was discovered that metal rod and wire was especially well suited for providing the trunk and branch structure for the miniature tree because the metal could be bent and shaped to realistically simulate a tree while still being compatible with the seeds or seed hulls and also being sufficiently strong to provide a durable miniature tree structure.

The above described and many other features and attendant advantages of the present invention will become better understood by reference to the following detailed description when taken in conjunction with the accompanying drawing.

DETAILED DESCRIPTION OF THE INVENTION

Figure 2:
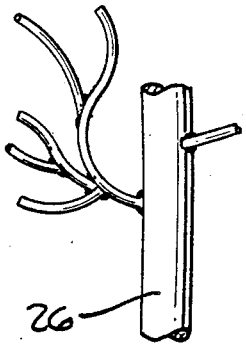
FIG. 2 is a detailed view of a miniature tree structure without the miniature leaves being attached.
Figure 3:
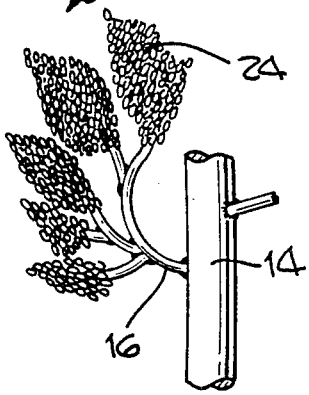
FIG. 3 is a detailed view of the tree structure after the miniature leaves, in accordance with the present invention, have been attached.
Figure 4:
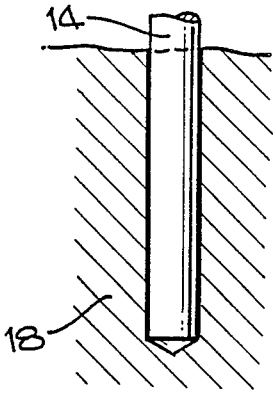
FIG. 4 is a sectional view of FIG. 1 taken in the 4—4 plane showing how the miniature tree trunk is mounted in the landscape base.
Figure 1:
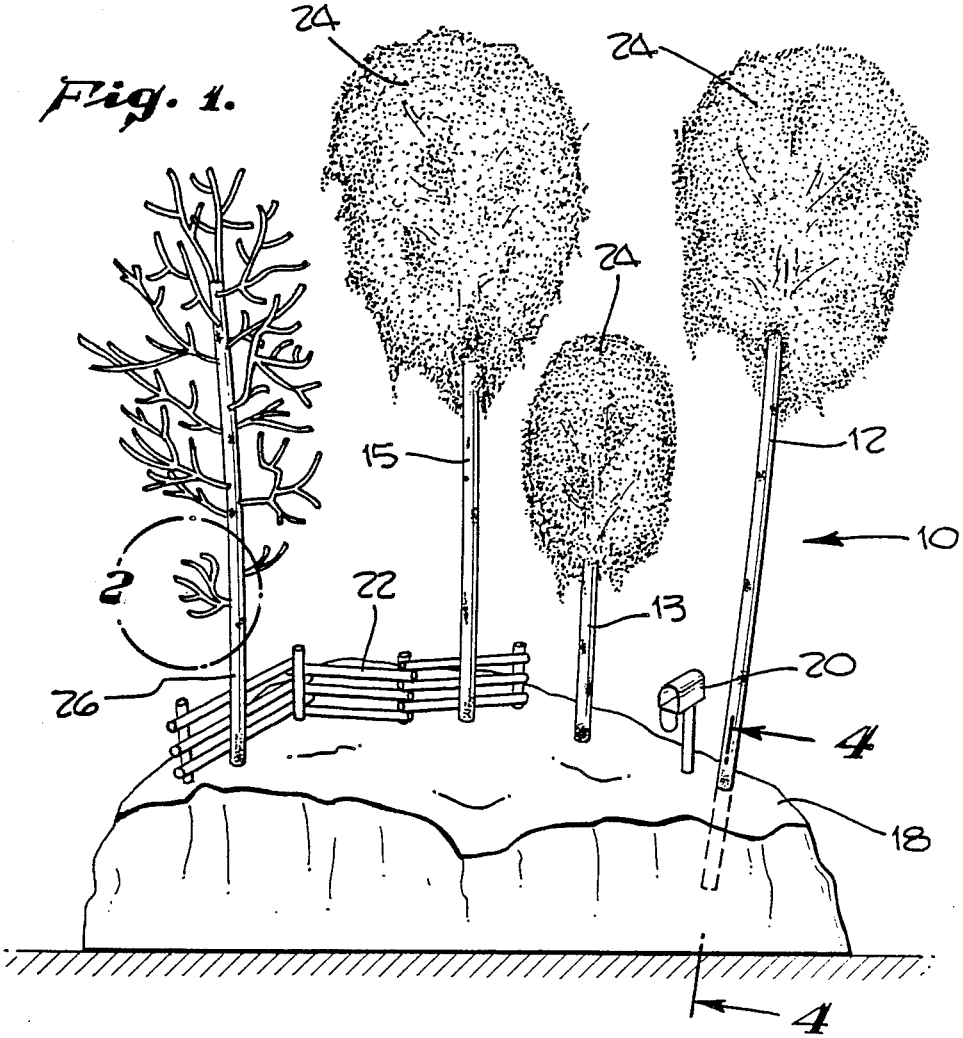
FIG. 1 is a perspective view of a landscape sculpture in which preferred exemplary embodiments of the invention are shown.

Preferred exemplary miniature tree sculptures in accordance with the present invention are shown generally at 10 in the drawing. The sculpture includes miniature trees 12, 13 and 15. As shown in FIG. 3, each tree includes an imitation tree trunk 14 and a branch structure 16. The miniature trees 12, 13 and 15 are shown as part of a landscape model wherein the tree sculptures 10 are mounted on a suitable base, such as an attractive rock 18. The landscape scene or model may further include miniature mail boxes 20, fences 22 and other suitable items which provide a realistic miniature setting for the tree sculpture 10. These items are made from conventional materials, such as metal, wood or plastic, and are attached to the rock base 18 by any conventional method.

Each of the tree sculptures 12, 13 and 15 includes a plurality of leaves z4 which are adhesively bonded to the branch structure 16 (see FIG. 3). A miniature tree 26 without leaves is also included as part of the landscape scene to show the trunk and branch structure of the miniature tree in accordance with the present invention prior to addition of the leaves.

The miniature trees 12, 13, 15 and 26 may be made from metal, wood, plastic or any other material which can be formed into a miniature tree which is compatible with the adhesive used to bond the leaves z4 to trees. The material must also be sufficiently strong to resist breakage after it is formed into the tree structure. Metal is the preferred material to be used in making the trees. The tree trunk is preferably made from standard welding or brazing rod having diameters ranging from 1/16-inch to $\frac{3}{8}$-inch in diameter. Diameters of 1/16, 3/32, $\frac{1}{8}$, 5/32, 3/16 and $\frac{1}{4}$-inch are preferred for making tree heights in the range of 6 inches to 20 inches. The branch structure is preferably made from metal wire having diameters of 0.010-inch up to about 0.040-inch. MIG wire having a diameter of 0.035-inch works well. The small diameter wire branches are attached to the larger diameter trunk metal rod by welding or other suitable means. The trunk rod and metal branches are then bent or sculpted into the shape of a miniature tree. A torch is preferably used to assist in sculpting the trunk and branches.

After sculpting, the miniature tree is painted to reflect the type of tree being imitated. In the preferred embodiment, the miniature tree is an aspen. Accordingly, the tree is painted with a white base coat and then painted with black markings typical of aspens. The leaves 24 are attached to the branch structure 16 after painting is completed. The leaves can be seeds or seed hulls. Suitable seeds include grass seeds having a size and shape which mimics the desired leaf structure. Grass seeds are well suited for used in making pine trees and other conifers. Seed hulls, such as millet seed hulls, are preferred when a broad leaf miniature tree is desired. In the preferred aspen embodiment, millet seed hulls are used for the leaves. Millet seed hulls are commonly available as a waste product produced during the conventional processing of millet seed. White millet seed hulls are particularly preferred.

The seeds or seed hulls are preferably dyed to achieve the desired leaf color or mixture of colors. Conventional food stuff dyes can be used for this purpose. In the preferred embodiment, the white millet seed hulls are dyed according to the following process: food coloring, vinegar and water are mixed to form a dye solution. The dye solution is heated to boiling and the millet seed hulls are then added. The resulting mixture is simmered for about thirty minutes. The solution is then drained off and the shells laid out to dry.

In preparing yellow leaves, one cup of millet seed hulls is added to one cup of water containing sixty drops of yellow food coloring and two tablespoons of vinegar. For green leaves, one cup of white millet seed shells is added to one cup of water containing eight drops of green food coloring, fourteen drops of yellow food coloring and four tablespoons of vinegar. Red leaves are made by adding one cup of white millet seed hulls to one cup of water containing fifty drops of yellow food coloring, fifty drops of red food coloring and two and one-half tablespoons of vinegar. Although a wide variety of different colors are possible, the above solutions and dying procedures are preferred when making aspen miniature trees because it was found that the resulting dyed white millet seed hulls provide a realistic and accurate imitation of natural aspen leaf coloring during various stages of growth and aging.

Various different millet seed hulls may be used, depending on the particular visual effect desired. White or yellow millet seed having diameters of less than ⅛-inch are preferred. The seeds are bonded to the branch structure using an adhesive which is applied onto the branches. The adhesive can be applied by conventional methods, such as spraying, dipping or any other procedure which provides a uniform and controllable coating of the branches. Construction-type adhesives, such as the spray adhesive marketed as Touch-N-Stick © by Convenience Products of St. Louis, Mo., are preferred. The spray adhesive allows control of adhesive application so that, when desired, only selected areas of the branches will have seed hulls or seeds bonded thereto.

After the adhesive is applied to the tree branches, the tree is then rolled or immersed in a bed of the dyed seed hulls or seeds. The tree is rolled or agitated within the seed hull/seed bed for a sufficient time to provide adhesive bonding of the seed hulls/seeds to the branch structure. The amount of adhesive applied to the branch structures and the time and degree of agitation of the branch structure within the seed hull/seed may be varied to achieve different leaf density. Further, additional seed hulls/seeds may be sprinkled onto areas of the branches which were not covered during the initial contact with the bed of seed hulls/seeds. If additional fullness is desired, the branches may be sprayed with some additional adhesive and seed hulls/seeds sprinkled onto the locations where additional adhesive has been sprayed.

The durability of the seed hulls/seeds and their attachment to the tree branches is increased by coating the tree sculpture with additional adhesive to provide seed hulls/seeds with a protective coating on their outer surfaces. The protective layer can be any of the conventional adhesives which will not adversely affect the seed hull/seed structure or appearance. Elmers Spray Adhesive ® marketed by the Borden Company (Columbus, Ohio) or Weldbond ® marketed by Frank T. Ross & Sons, Inc. (Dalton, Ill.) are suitable adhesives for use in coating the structure. One or more coats of the adhesive may be applied and preferably the adhesive is a water soluble, non-toxic adhesive which can be diluted with water to provide application of a thin adhesive coating by dipping or spraying. It was found that two thin coats of adhesive provides increased leaf (i.e., seed hull) durability without adversely affecting the visual appearance of the seed hulls. Other protective coatings include various paints such as clear lacquer or other clear polymeric coating which provides a thin, clear coating which does not detract from the visual appearance of the seed hulls/seeds. The above mentioned adhesives are preferred because they not only provide a protective layer surrounding the seed hulls/seeds, but also provide increased attachment strength and durability.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein, but is only limited by the following claims.

What is claimed is:

1. A miniature tree sculpture comprising:

a miniature tree comprising an imitation tree trunk and branch structure; and a plurality of imitation leaves adhesively bonded to said tree, said imitation leaves being selected from the group consisting of grass seeds and seed hulls.

2. A miniature tree sculpture according to claim 1 wherein said miniature tree is metal.

3. A miniature tree sculpture according to claim 1 wherein said imitation leaves are seed hulls.

4. A miniature tree sculpture according to claim 2 wherein said imitation leaves are seed hulls.

5. A miniature tree sculpture according to claim 4 wherein said seed hulls are millet seed hulls.

6. A miniature tree sculpture according to claim 1 wherein said grass seeds or seed hulls are dyed.

7. A miniature tree sculpture according to claim 1 wherein said imitation leaves include an outer surface having a protective coating thereon.

8. A method for making a miniature tree sculpture comprising the steps of:

forming a miniature tree comprising an imitation tree trunk and branch structure; and adhesively bonding a plurality of imitation leaves to said tree, said imitation leaves being selected from the group consisting of grass seeds and seed hulls.

9. A method for making a miniature tree sculpture according to claim 8 wherein said miniature tree is made from metal.

10. A method for making a miniature tree sculpture according to claim 8 wherein said imitation leaves are seed hulls.

11. A method for making a miniature tree sculpture according to claim 9 wherein said seed hulls are millet seed hulls.

12. A method .for making a miniature tree sculpture according to claim 8 including the step of dying said grass seeds or seed hulls prior to adhesively bonding them to said tree.

13. A method for making a miniature tree sculpture according to claim 8 including the step of coating said imitation leaves with a protective layer after said imitation leaves have been adhesively bonded to said tree.

14. A method for making a miniature tree sculpture according to claim 13 wherein said imitation leaves are seed hulls.

* * * * *